United States Patent [19]

De Burro

[11] Patent Number: 4,824,377

[45] Date of Patent: Apr. 25, 1989

[54] UNMATED PIN CONNECTOR HAVING IMPROVED ELECTROSTATIC DISCHARGE PROTECTION

[75] Inventor: Agostino L. De Burro, Atkinson, N.H.

[73] Assignees: Americal Telephone and Telegraph Company, New York, N.Y.; AT&T Bell Laboratories, Murray Hill, N.J.

[21] Appl. No.: 151,841

[22] Filed: Feb. 3, 1988

[51] Int. Cl.[4] ..... H01R 13/53

[52] U.S. Cl. ..... 439/186; 439/607

[58] Field of Search ..... 439/181, 182, 186, 187, 439/607–610

[56] References Cited

U.S. PATENT DOCUMENTS 4,418,972 12/1983 Benasutti ..... 439/607
4,477,134 10/1984 Wright ..... 339/17
4,531,176 7/1985 Beecher, II ..... 361/424
4,568,133 2/1986 Amano et al. ..... 439/181
4,688,868 8/1987 Noyes ..... 439/108

*Primary Examiner*—Eugene F. Desmond
*Attorney, Agent, or Firm*—Eli Weiss

[57] ABSTRACT

A female pin connector is disclosed which inhibits damaging levels of an electrostatic discharge from entering the unmated pin connector. The female pin connector supports a conductive barrier member at the mating end of the pin contacts. The conductive barrier member, which can be in the form of a conductive sheet, strip, wire, printed circuit or the like is located outward from and encompasses the mating end of the pin contacts. The conductive barrier member is adapted to be coupled to a member which can receive and safely dissipate the electrostatic discharge.

4 Claims, 2 Drawing Sheets

UNMATED PIN CONNECTOR HAVING IMPROVED ELECTROSTATIC DISCHARGE PROTECTION

TECHNICAL FIELD

This invention relates to a method and apparatus for protecting electronic components from damaging levels of transient voltages and more particularly to preventing damaging levels of electrostatic discharge from entering equipment through an unmated pin connector.

DESCRIPTION OF THE PRIOR ART

Background of the Invention

The use of pin type connectors to connect and disconnect assemblages of electronic components to form a complete system has obvious advantages. Thus, an operating system which normally comprises a multitude of discrete assemblages will include a pin type of connector on each assemblage.

Assemblages of electronic components can comprise integrated circuit boards, read only memories and the like. Devices and components such as these are very sensitive to and can be damaged by transient voltages. One such source of transient voltage that can cause permanent damage to electronic components is an electrostatic discharge.

During the course of normal activities, it is possible for a person to inadvertently build up an electrostatic voltage which can be in excess of 20,000 volts. This voltage is normally dissipated without harm. In some situations a human will be unaware that the electrostatic voltage has been discharged. Occasionally, on very dry days, the electrostatic voltage can reach levels which are higher than normal.

An electrostatic discharge normally presents no harm to a human. However, as noted above, it can be potentially damaging to certain electronic components. A specific instance of concern is when the electrostatic voltage is discharged into an assemblage of electronic components. More specifically, when a pin connector is unmated, the electronic components which are connected to this unmated connector are susceptible of receiving, through the unmated connector, an electrostatic discharge which can result from an electrostatically charged human or other sources of an electrostatic charge. These other sources of electrostatic charge may include furniture and mating cable assemblies.

Briefly, this invention is directed toward a new type of pin connector which, when not mated, prevents damaging levels of an electrostatic discharge from reaching the pins of the connector. Thus, with this invention, the pin connector can be disconnected from other assemblies and left unmated for an extended period of time without concern that an electrostatic discharge will inadvertently enter the unmated pin connector and damage associated sensitive electronic components.

SUMMARY OF THE INVENTION

A pin connector in accordance with the principles of this invention is disclosed which, when unmated, prevents damaging levels of an electrostatic discharge from reaching the pins of the connector. More specifically, an electrostatic discharge barrier, which can be a conductive member, adaptable to be coupled to a ground terminal, is positioned in close proximity to the pins of the connector.

BRIEF DESCRIPTION OF THE DRAWING

A more complete understanding of the invention can be obtained from the following description of specific illustrative embodiments of the invention in combination with the appended drawing wherein.

In the various figures of the drawing similar parts have similar reference numerals.

This invention relies upon the basic laws of electrostatics to controllably fix the location where an electrostatic discharge will occur. Briefly, to help attain this result, the electric field strength is maximized at the location selected for discharge. Field strength can be maximized by minimizing the distance between the source of electrostatic charge and the location selected for the discharge to occur and, additionally, by maximizing the surface charge density at the desired location of discharge.

In this invention, distance is minimized by positioning an electrostatic discharge barrier between the source of the electrostatic charge and the pins of the connector. Surface charge density is increased by providing the electrostatic discharge barrier with sharp points or edges with relatively small radii.

DETAILED DESCRIPTION

Figure 1:
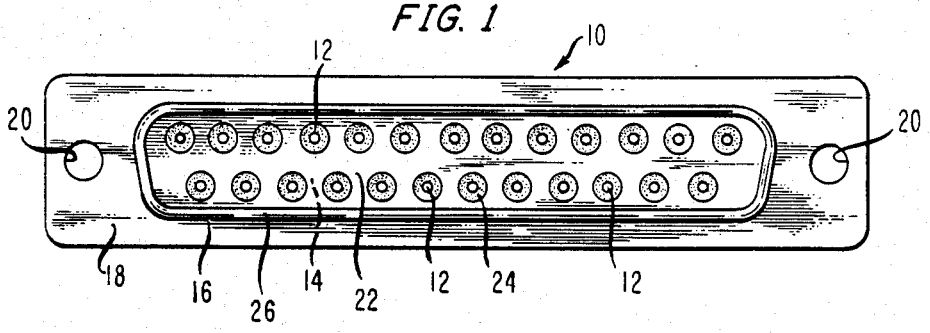
FIG. 1 is a top view of the female portion of a 25 pin connector having an electrostatic discharge barrier in accordance with the principles of the invention.

Referring to FIG. 1, there is illustrated a female pin subminiature connector. The connector 10 contains a double row of pin contacts 12 supported within an insulative support number 14. A conductive metallic shell 16 is positioned around the sides of the support member 14 and is secured rigidly to member 14. The conductive metallic shell supports a conductive metal flange 18 which contains two mounting openings 20 sized to accommodate mounting screws. In use, screws, bolts or the like can be positioned through the openings 20 to secure the pin connector to a support member.

Positioned on top of the insulative support member 14 is a conductive member 22 which, in combination with the top edge 26 of the metallic shell 16, functions as a barrier to inhibit an electrostatic discharge from reaching the pins of the connector. The conductive barrier member 22, which can be of copper, aluminum, or any other material which is conductive, contains a plurality of passageways 24, one passageway being provided for each pin of the connector. Each passageway 24 is sized to permit a pin contact from a male member of a pin connector to pass through the conductive barrier member 22 without touching the barrier member after an electrical connection is made with an associated pin contact in the female member of the pin connector. Normally, the conductive barrier member 22 is electrically connected to the top edge 26 of the metallic shell 16 and to the metallic flange 18, and is electrically isolated from the pins of the connector. Sometimes it may not be possible to electrically ground the metallic shell of the connector. In this instance, the conductive barrier member 22 can be connected to one or more of the unused pins which can then be connected to a suitable electrical ground. In some applications, pin 1 of the connector is assigned to be connected to a suitable electrical ground.

The top edge 26 of the metallic shell 16 and the top edges of the openings 24 of the conductive barrier member can be provided with sharp edges to help maximize surface charge density.

In operation, the pins of the connector, normally a female connector, are connected via conductive wires to one or more electronic components. The connector is normally secured to a metal frame member by screws or the like which pass through openings 20. Thus, the metal frame member, which is normally maintained at ground potential, is electrically connected through the mounting screws, the flange 18 and the shell 16 to the conductive barrier member 22.

A pin connector 10 and its associated electronic components can remain unmated for an extended period of time. During this interval, the unmated connector is subject to being touched by an electrostatically charged human or other sources of electrostatic charge. For example, if an unmated pin connector is inadvertently touched by an electrostatically charged human, the resulting electrostatic discharge from the human can be sufficient to damage or destroy associated circuit components. It is not uncommon for an electrostatic charge of approximately 2,000 volts to be on a human. A discharge of this magnitude is more than adequate to damage an electronic circuit, although it is normally below the feeling of sensation of a human. Under more favorable conditions, the electrostatic charge on the human body can become 5,000 or 6,000 volts. At this level, a shock is felt by the human at discharge. In another instance, by placing an unmated connector onto a work table that is not properly protected, the connector can be exposed to an electrostatic discharge. The source of electrostatic charge in this instance can be the work table.

Tests have clearly demonstrated that the electrostatic discharge barrier disclosed in FIG. 1 effectively protects all electronic components which are connected to the unmated pin connector. In no instance did a damaging level of electrostatic discharge pass beyond the barrier and enter a pin contact of the unmated pin connector.

Figure 3:
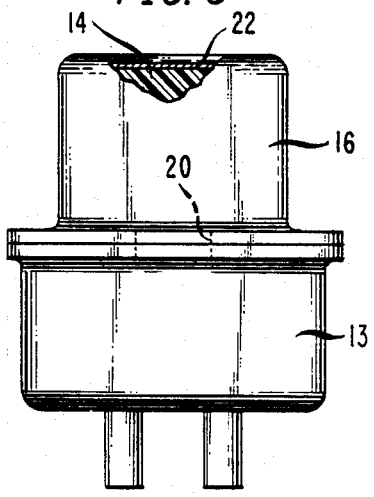
FIG. 3 is a partially cut away side view of the pin connector of FIG. 1.
Figure 4:
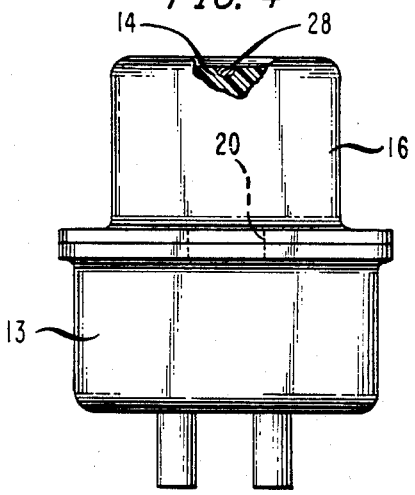
FIG. 4 is a partially cut away side view of the pin connector of FIG. 2.

FIG. 3 is a partially cut away side view of the female pin connector of FIG. 1. The conductive barrier member 22 is made of a sheet or film of copper having a thickness of approximately 0.007 inches. The clearance openings or passageways 24 are sized to avoid any physical contact between the pin contacts of the pin connector and the conductive barrier member 22. A metal shell connector may also have a lower metal flange 13 that is mechanically fastened to flange 18. In this case, both flanges 13, 18 act to support and contain the remaining connector elements.

Figure 2:
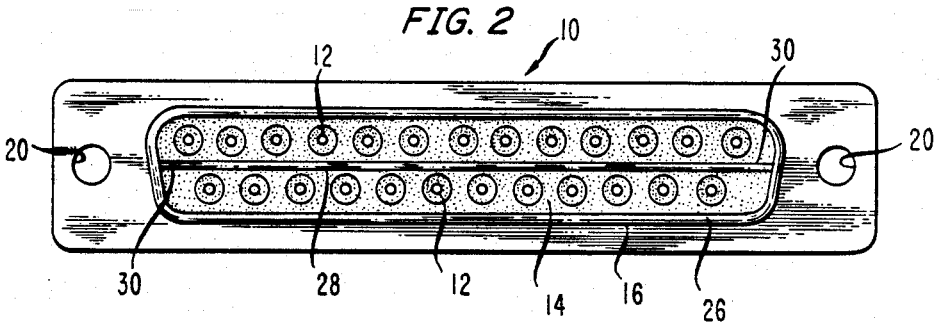
FIG. 2 is a top view of the female portion of a 25 pin connector having another electrostatic discharge barrier in accordance with the principles of the invention.

Referring to FIG. 2, there is illustrated a top view of the female portion of a pin connector having another embodiment of an electrostatic discharge barrier member. Specifically, a conductive wire 28 is substituted for the conductive sheet or film 22. The conductive wire 28 is positioned between the two rows of pin contacts 12. In the embodiment illustrated, the wire is copper and has a diameter of 0.010 inches. It is positioned within a slot cut into the top surface of the insulative support member 14. The slot is 0.010 inches wide and 0.008 inches deep. The 0.010 inch width of the slot accommodated the 0.010 inch diameter wire which is 30 gauge. The 0.008 inch depth of the slot allowed 0.002 inches to be removed from the top surface of the wire after it was installed in the slot. Removal of 0.002 inches from the top of the wire provides sharp edges to the otherwise round top surface of the wire. Each end 30 of the wire 28 is connected to the metal shell 16 via the top edge 26.

The conductive wire 28, in combination with the top edge 26 of the metal shell 16, forms the electrostatic discharge barrier member. Obviously, if desired, the conductive wire 28 can be replaced with a conductive member which is etched, printed, painted or the like onto the insulative support member 14.

Tests have clearly demonstrated that the electrostatic discharge barrier disclosed in FIG. 2 effectively protects all electronic components which are connected to the unmated pin connector. In no instance did a damaging level of electrostatic discharge pass beyond the barrier and enter a pin contact of the unmated pin connector.

Figure 5:
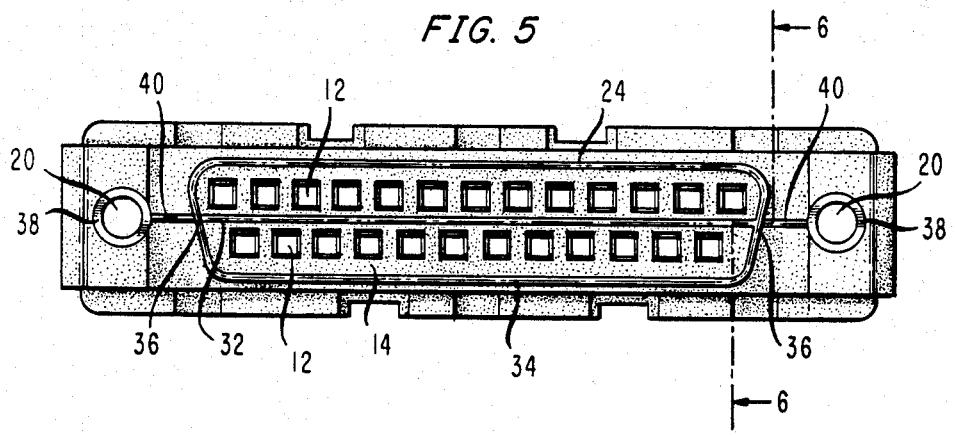
FIG. 5 is a top view of the female portion of an all plastic body 25 pin connector having still another electrostatic discharge barrier in accordance with the principles of the invention.
Figure 6:
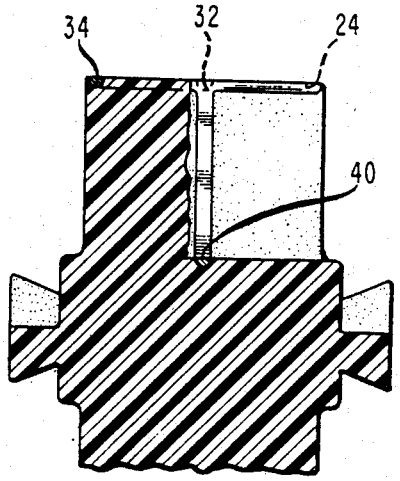
FIG. 6 is a side view along the line 6-6 of FIG. 5.

In some instances it may be desirable to use a pin connector which does not have the metal flange 13 and 18 and shell 16 as illustrated in FIGS. 1, 2, 3 and 4. Referring to FIGS. 5, and 6, there is illustrated the female portion of an all plastic body pin connector having an electrostatic discharge barrier in accordance with the principles of the invention. More specifically, the electrostatic discharge barrier can comprise one or more wires configured to circle the two row of pins. If two wires are used, one conductive wire 32 can be positioned on the insulative support member 14 to traverse a path between the two rows of pin contacts 12. The other wire 34 can be positioned to traverse a path around the edge of the insulative support member 14. Conductive wire 32 can be connected, at each end 36, to wire 34. Two openings are provided to facilitate the mounting of the pin connector. Each opening can contain a threaded bass bushing 38. A conductive wire 40 connects electrically each brass bushing 38 with the wires 32, 34. As illustrated, the conductive wires 40 can be connected to the wires 32, 34 at the junction 36.

The wires 32, 34 and 40 can be inserted into slots cut into the insulative support member 14, and the top portion of the wires 32, 34 can then be removed to provide sharp edges. If desired, the wires can be made an integral part of the connector when the connector is formed by moulding. Naturally, the wires can be replaced with conductive paths which are applied to the surface of the insulative support member 14 by any convenient method such as printing or the like.

In operation, the pin connector of FIG. 5 is mounted to a metal member by means of screws which, after passing through clearance openings in the metal member, are threaded into the brass bushings 38. This simple procedure electrically connects the wires 32, 34 and 40 to a metal member which is normally maintained at ground potential. FIG. 6, which is a side view along the line 6—6 of FIG. 5, illustrates in more detail the position of the conductive wires 32, 34, 40.

In the female part of one type of pin connector, the pin contacts have a circular cross section. In other types of pin connectors, the pin contacts have a square cross section. Either type of pin connector can be used with the invention as shown in the figures where FIGS. 1 and 2 illustrate pin connectors having a circular cross section and FIG. 5 illustrates pin connectors having a square cross section.

Illustrative embodiments of the invention have been described. Clearly, numerous departures may be made therefrom without departing from the spirit or scope of the invention.

What is claimed is:

1. A female pin connector which, when not mated, prevents damaging levels of an electrostatic discharge from reaching a pin of the connector, comprising, a body fabricated of an insulative material having a plurality of contact housing channels defined therein said contact housing channels having, at one end, pin insertion holes, a plurality of contacts disposed in said contact housing channels for electric connection to conductive pins of a mating plug upon insertion of the conductive pins through the pin insertion holes, and a conductive wire supported by the body of insulative material and traversing a path which encircles said pin insertion holes, said conductive wire being coupled to a grounding terminal whereby an electrostatic discharge directed towards the conductive pins of the female pin connector when not connected to a mating plug will be discharged through said conductive wire and grounding terminal rather than being discharged to the contacts of the female pin connector.

2. The female pin connector of claim 1 wherein said conductive wire is shaped to have a sharp edge along its top surface to help maximize surface charge density.

3. The female pin connector of pin 1 wherein said plurality of contact housing channels are positioned to form rows and columns, and, said conductive wire is positioned to encircle each row or each column of pin insertion holes of the contact housing channels.

4. A female pin connector which, when not mated, prevents damaging levels of an electrostatic discharge from reaching a pin of the connector comprising a body fabricated of an insulative material having a plurality of contact housing channels positioned to form two or more rows defined therein, said contact housing channels having, at one end, pin insertion holes, a contact disposed in each of said contact housing channels for electric connection to conductive pins of a mating plug upon insertion of the conductive pins through the pin insertion holes, a metallic sleeve positioned around the sides of the body fabricated of an insulative material, the edge of the metallic sleeve being substantially flush with the surface of the body having the pin insertion holes and shaped to have a sharp edge, a conductive wire positioned between the pin insertion holes of the rows of contact housing channels and electrically coupled to said metallic sleeve and to a grounding terminal, said conductive wire being shaped to have a sharp edge whereby an electrostatic discharge directed towards the conductive pins of the female pin connector when not connected to a mating plug will be discharged through the metallic sleeve or the conductive wire to the grounding terminal rather than being discharged to the contacts of the female pin connector.

* * * * *